US005649378A

United States Patent [19]

Roesser, Jr. et al.

[11] Patent Number: 5,649,378

[45] Date of Patent: Jul. 22, 1997

[54] ADDRESS DISPLAY SYSTEM WITH DIRECT ILLUMINATION

[75] Inventors: Eugene F. Roesser, Jr., North Potomac, Md.; Robert P. Martins, Alexandria, Va.

[73] Assignee: Roesser-Martins, Inc., North Potomac, Md.

[21] Appl. No.: 398,239

[22] Filed: Mar. 3, 1995

Related U.S. Application Data

[63] Continuation-in-part of Ser. No. 71,499, Jun. 4, 1993, abandoned.

[51] Int. Cl.[6] ..... G09F 13/02

[52] U.S. Cl. ..... 40/559; 40/543; 40/568; 362/812

[58] Field of Search ..... 40/559, 541, 543, 40/546, 576, 568, 442; 362/812

[56] References Cited

U.S. PATENT DOCUMENTS

| | | | |
|---|---|---|---|
| D. 356,119 | 3/1995 | Roesser, Jr. et al. | D20/17 |
| 566,553 | 8/1896 | Wright | 362/241 |
| 1,004,503 | 9/1911 | Troy | 40/543 |
| 1,354,437 | 9/1920 | Lowd | 40/559 |
| 2,648,152 | 8/1953 | Simpson | 40/576 |
| 3,614,727 | 10/1971 | Fritts | 40/471 |
| 4,009,535 | 3/1977 | Stock | 40/546 |
| 4,849,864 | 7/1989 | Forrest | 40/559 X |
| 4,937,499 | 6/1990 | Hunte | 40/568 |
| 5,309,656 | 5/1994 | Montgomery | 40/442 |

*Primary Examiner*—Peter M. Cuomo
*Assistant Examiner*—James O. Hansen
*Attorney, Agent, or Firm*—Lowe, Price, LeBlanc & Becker

[57] ABSTRACT

An address illumination system includes a lamp and a lamp housing arrangement mounted to a base structure having display symbols thereon. The lamp housing directly illuminates the display symbols to provide improved visibility and aesthetic appeal. The lamp housing can be elongated and either spaced from the display symbols by support bars attached to the base or directly mounted to the base. The lamp housing is configured to angle the illumination from the lamp to increase visibility of the display symbols such as a house address during nighttime. The address illumination system also includes control features to provide a flashing lamp to signal emergency vehicles or the like as well as remote control operation, photocell operation and/or operation at predetermined intervals of time. The address illumination system can be mounted to a structure such as a building or mail box. Alternatively, the lamp and lamp housing arrangement can be utilized to illuminate display symbols or house addresses found on existing structures.

7 Claims, 4 Drawing Sheets

Fig. 7
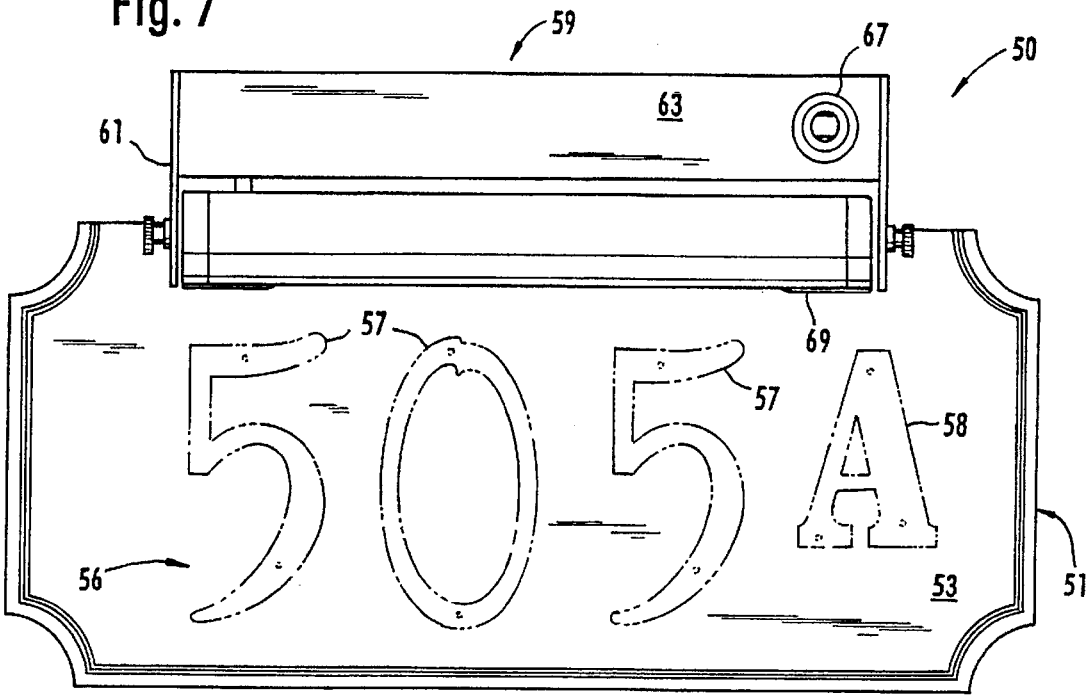
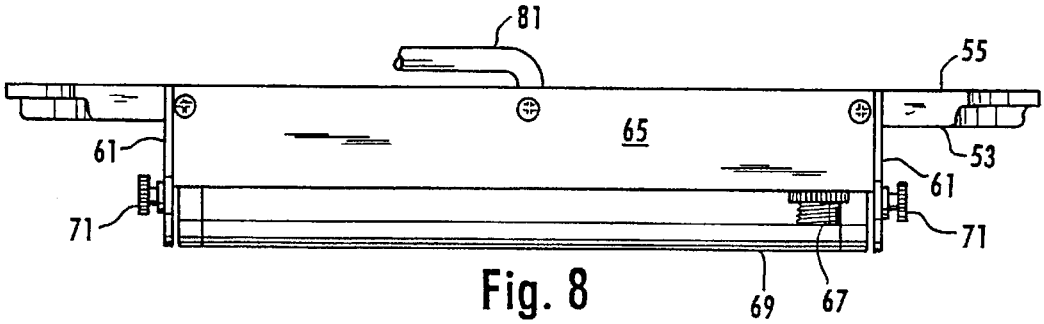
Fig. 8
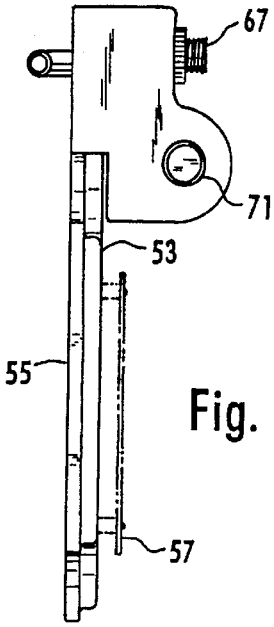
Fig. 9

Fig. 10
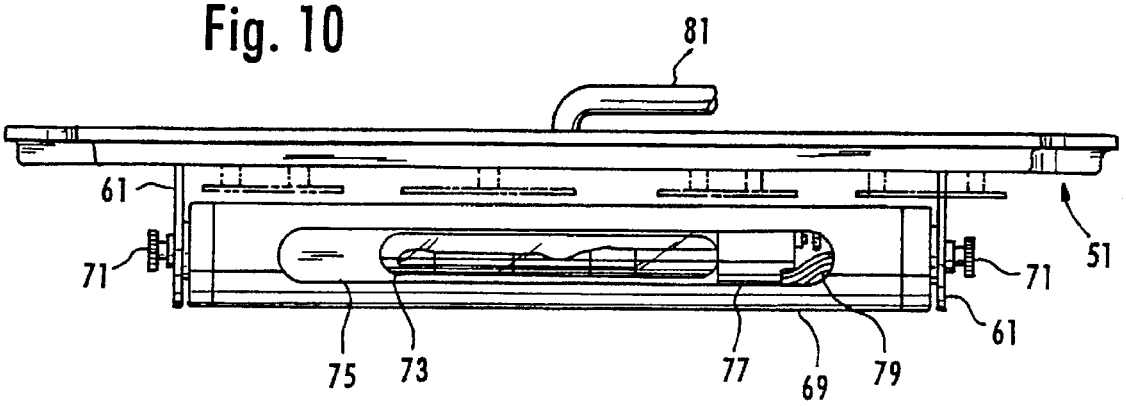
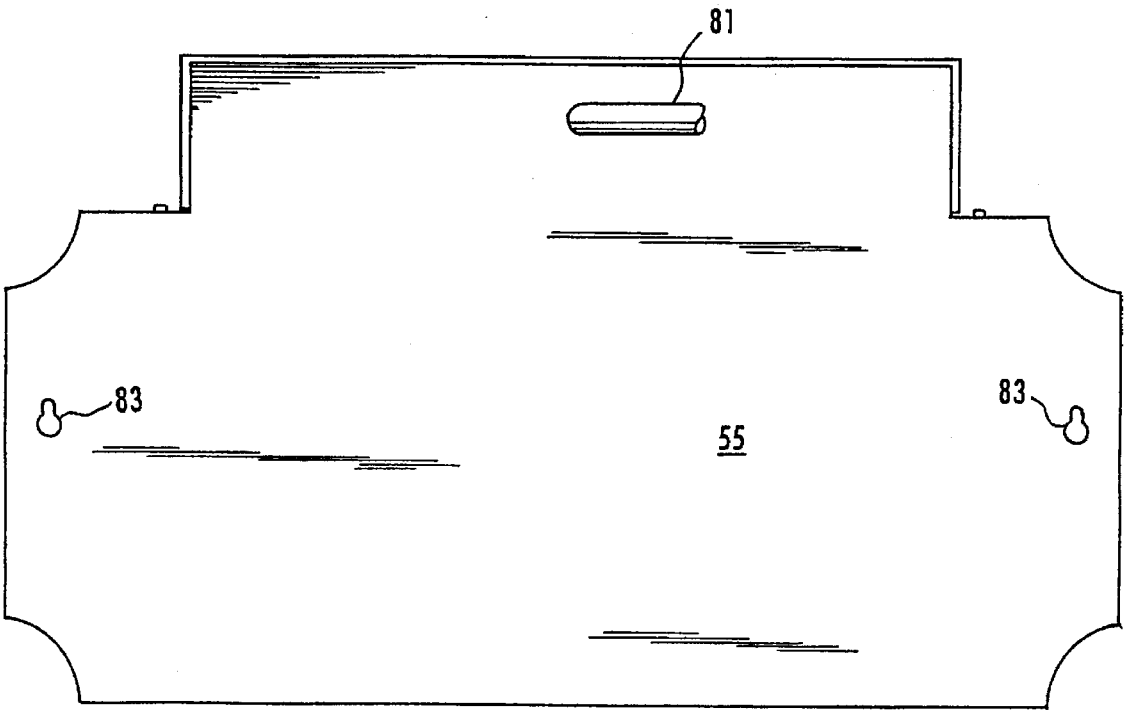
Fig. 11

ADDRESS DISPLAY SYSTEM WITH DIRECT ILLUMINATION

This application is a continuation-in-part of application Ser. No. 08/071,499 filed Jun. 4, 1993 now abandoned.

FIELD OF THE INVENTION

The present invention is directed to an address display system with direct illumination having features which improve the visibility of an address and enhance the appearance thereof.

BACKGROUND ART

In the prior art, various and different types of illuminated displays have been proposed for building or house addresses. In U.S. Pat. No. 4,611,265 to Davis, a lighted address display is disclosed which utilizes translucent material and opaque numbering to back light the address. This patent also discloses an additional emergency light circuit arranged in parallel with a lamp that illuminates the address display.

In U.S. Pat. No. 4,254,457, an illuminated construction for display of a house number or the like is disclosed which is constructed from simplified multiple function extruded and molded components. This sign construction uses back lighting to illuminate the numerical indicia made of a transparent material.

Drawbacks of prior art address illumination systems include an unappealing design for attachment to a building surface caused by the bulky box-like structures required for back lighting. Furthermore, since either the numbering or the surrounding material must be transparent or translucent to facilitate illumination, ornate numbering using materials such as brass and/or wood typically used in more expensive houses cannot be readily used. The prior art illuminated sign constructions are also more expensive and complex to manufacture given the various components required for back lighting.

In view of the disadvantages of the prior art address displays discussed above, a need has developed to provide an address display system which provides improved visibility and aesthetic appeal. In response to this need, the present invention provides a system utilizing direct illumination and including features having improved aesthetic appeal and increased visibility.

SUMMARY OF THE INVENTION

It is a first object of the present invention to provide an improved address display illumination system.

Another object of the present invention includes providing an address display system utilizing direct illumination and an attractive design for use on a house or building structure.

A further object of the present invention includes an address display system having features to signal emergency vehicles, improve visibility and permit remote control operation.

It is a still further object of the present invention to provide an address display system which permits the selection of a wide range of address display symbol materials, provides flexibility by modifying existing systems and offers a complete system for installation.

Other objects and advantages of the present invention will become apparent as the description thereof proceeds.

In satisfaction of the foregoing objects and advantages, there is provided an illumination system including a base and at least one display symbol, the back side of the display symbol being mounted to a front face of the base. The base is mountable to a surface of a building or other similar structure. Also provided is at least one illumination source connectable to a power source. The illumination source is mounted to the base and spaced from the display symbol to provide direct illumination thereto.

The illumination source includes a housing enclosing a portion of a lamp so that a remaining portion of the lamp directly illuminates the display symbol. The housing can be mounted using support arms to space the housing from the display symbols. Alternatively, a pair of housings may be utilized, each housing directly mounted to the base. In a further alternative, the housing has a recess with an aperture or opening facing the display symbol with the lamp mounted within the recess. The opening allows insects to escape from the recess.

In another embodiment, the lamp and housing arrangement can be mounted to a structure such as a building, fence or mail box to directly illuminate display symbols thereon.

The address display system can also include various control features such as flashing the illumination source on demand to signal an emergency vehicle. The illumination source can also be operated for predetermined time intervals using a timing means or through the use of a photoelectric cell for nighttime use only.

BRIEF DESCRIPTION OF DRAWINGS

Reference is now made to the drawings accompanying the invention wherein:

FIG. 7 is a front elevational view of another embodiment of the invention;

FIG. 8 is a top view of the embodiment shown in FIG. 7;

FIG. 9 is a side elevational view of the FIG. 7 embodiment.

FIG. 10 is a bottom view of the FIG. 7 embodiment; and

FIG. 11 is a rear view of the FIG. 7 embodiment.

DESCRIPTION OF THE PREFERRED EMBODIMENTS

Advantages of the present invention over prior art address illumination systems include improved visibility and aesthetic appeal. The inventive address illumination system is adaptable for residential, commercial and industrial use. In particular, the address illumination system can be mounted to a house or building to illuminate an address thereof. Alternatively, the inventive system can be utilized on a mail box, mail box post, fence or any structure remote from a house or building.

The address illumination system according to the present invention includes features for signaling emergency vehicles, nighttime deliveries or visitors. Operation can be controlled by switching means or remote control operation. Using direct illumination, the inventive system permits the use of address display symbols which are compatible with the building or house decor, such as brass, wood, metal numbering, or other symbols.

Figure 1A:
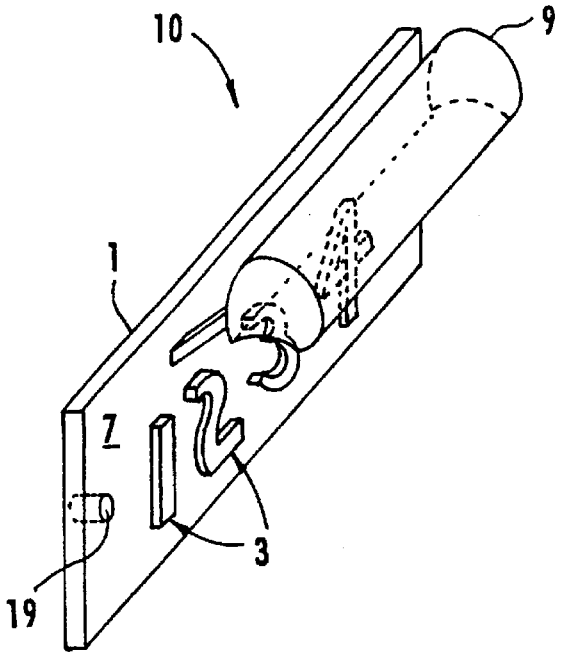
FIGS. 1A, 1B and 1C are a perspective view, side view, and front view of a first embodiment of the present invention.
Figure 1B:
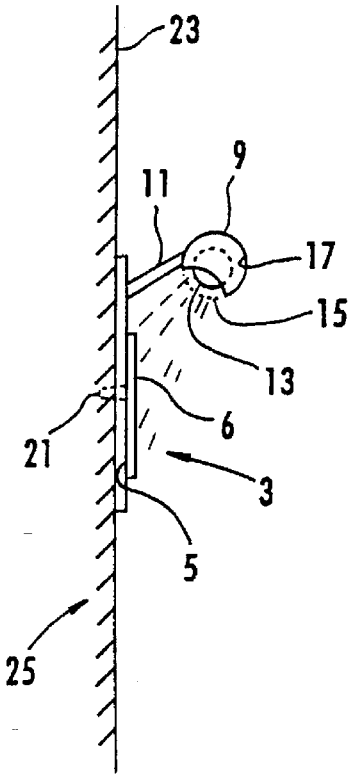
Figure 1C:
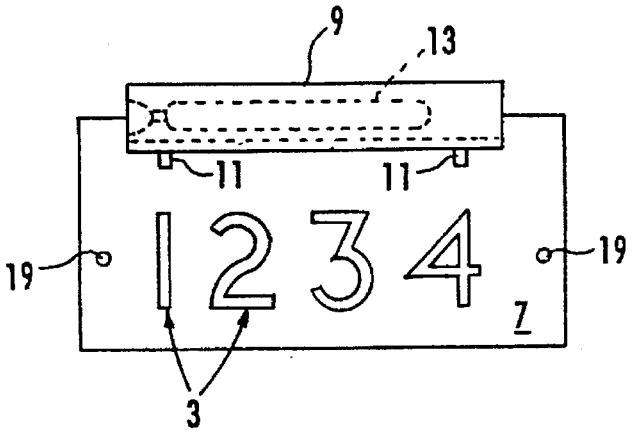

With reference now to FIGS. 1A–1C, a first embodiment of the present invention is generally designated by the reference numeral 10 and includes a base 1 and a plurality of display symbols 3. The backside 5 of the display symbols are mounted to the surface 7 of the base. The display symbols can be mounted using an adhesive (not shown) or other fastening means such as screws or the like. Alternatively, the display symbols 3 may be integrally formed as part of the base plate 1 or surface 7. The front face 6 of the display symbols 3 may include a reflective coating thereon to enhance illumination.

A lamp housing 9 having a lamp 13 mounted therein is mounted to the base plate 1 by a pair of supports 11. The supports 11 can also serve as a channel for electric wiring (not shown) that conducts power to the lamp 13.

The lamp housing 9 includes an opening 15 which facilitates lamp removal and directs light emanating from the lamp 13 to the display symbols 3. Optionally, the opening 15 can be covered with a clear or translucent lens capable of transmitting sufficient light to the display symbols while maintaining weather tight conditions for the lamp housing.

The housing can have a reflective inner surface 17 to enhance the illumination of the display symbols 3.

The base 1 includes openings 19 therethrough which permit attaching the base 1 to a surface 3 of a structure using fasteners 21. Of course, other modes of attachment may be used. The base plate 1 can be attached to any structure such as the face of a building or residential home.

The base 1 can be made of any material, including the same material of construction used for the display symbols 3. For example, both the base and display symbols can be manufactured from a brass or a brass-containing or brass-like material, wood, plastic or another metallic material such as a wrought or cast iron or steel.

Figure 2:
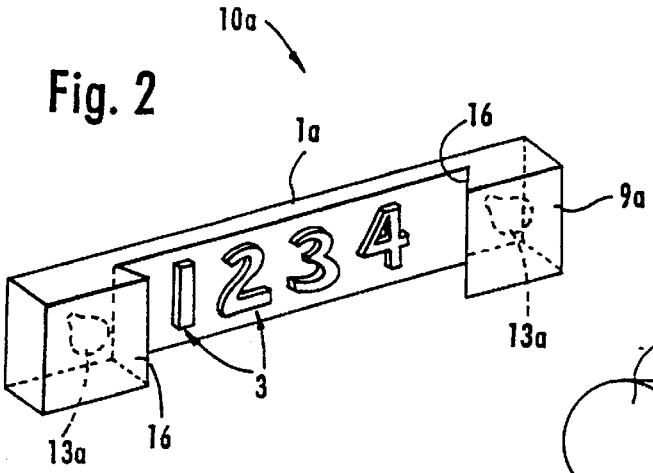
FIG. 2 is a perspective view of a second embodiment of the present invention.

With reference now to FIG. 2, a second embodiment of the present invention designated by reference numeral **10*a* include a base 1*a* and a pair of lamp housings 9*a* integrally formed therewith. Alternatively, the lamp housings 9*a* may be made separable and removable from the base 1*a*. The lamp housings 9*a* enclose lamps 13*a* and include lenses 16 which direct light from the lamps 13*a* to the display symbols 3. The lamp housings 9*a* are generally square when viewed from the front side of the address illumination system. Lenses 16 are angled to direct the light from lamps 13*a* towards the display symbols 3. In a further embodiment, the lenses 16 can be a focal-type lens to more directly illuminate the display symbols 3. The lamp housings 9*a* may also have an opening in substitution for the lenses 16 similar to the embodiment depicted in FIG. 1*a*. The housings 9*a*, when made removable from the base 1*a*, can also shield the means to fasten the base to a selected surface. Alternatively, openings similar to the openings 19 shown in FIG. 1*a*** may be spaced from the lamp housing to permit base attachment to a given surface.

Figure 3A:
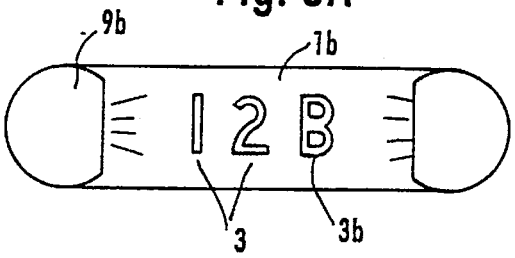
FIGS. 3A and 3B are alternative embodiments of the invention as shown in FIG. 2.
Figure 3B:
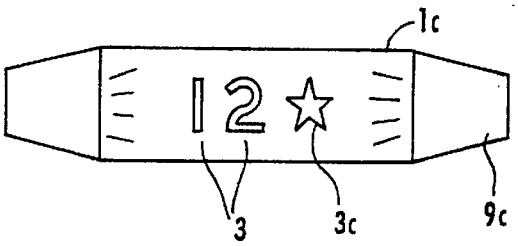

FIGS. **3*a* and 3*b* show alternative embodiments utilizing the pair of lamp housings shown in FIG. 2. In FIG. 3*a*, rounded lamp housings 9*b* are shown in spaced relationship on the base 1*b*. Display letter "B" is shown in combination with the display numerical symbols 3**.

In FIG. **3*b*, trapezoidal-shaped lamp housings 9*c* are shown with base 1*c*. In this embodiment, an alternative shape 3*c* is shown in combination with the numerical display symbols 3**.

Figure 4:
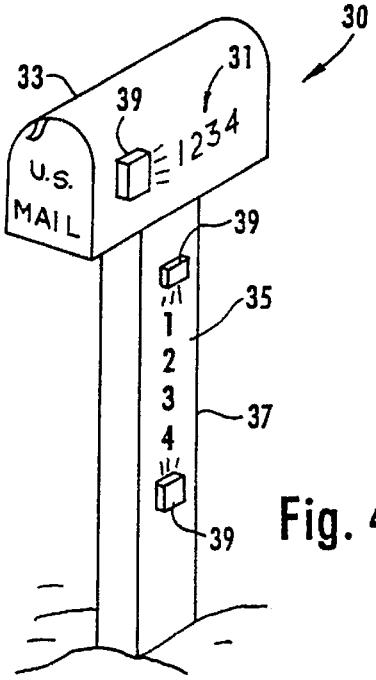
FIG. 4 is a perspective view of a third embodiment of the present invention.
Figure 5:
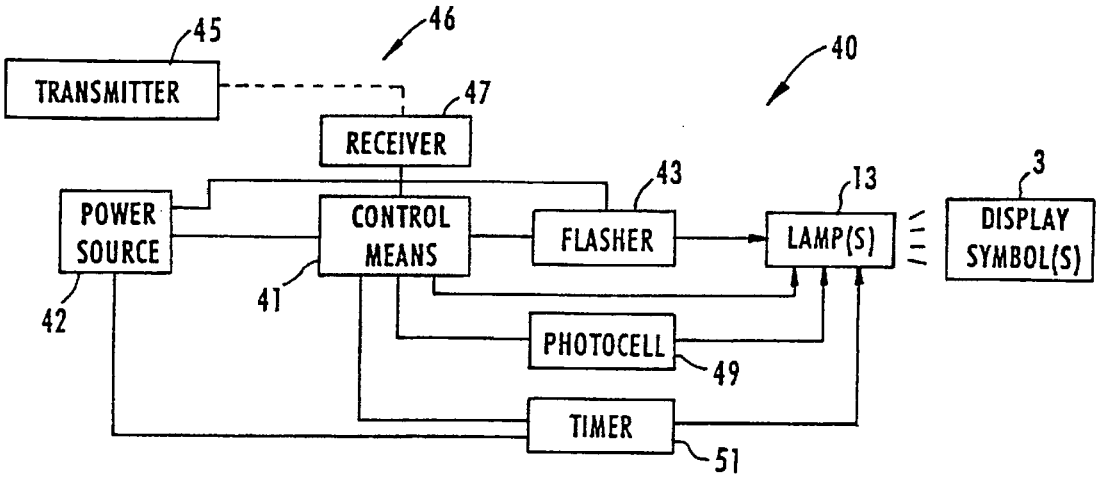
FIG. 5 a schematic diagram of the invention depicting various electrical components for controlling operation.

In another aspect of the invention, the lamp housing or housings 9 may be mounted to a structure surface to illuminate display symbols thereon. For example, with reference to FIG. 4, a mail box assembly 30 has postal numerals 31 on the mail box 33 or postal numerals 35 on the mail box support 37. In either case, one or more lamp and lamp housing arrangements 39 may be mounted on a portion of the mail box assembly to directly illuminate either or both of the postal numerals 31 and 35. Although a generally square-shaped lamp housing assembly 39 is shown, other configurations such as those disclosed in FIGS. **3*a* and 3*b* may be used. Alternatively, the lamp housing 9 and support 11 assembly shown in FIG. 1*a*** may be used to illuminate existing display symbols on a building or structure surface.

Figure 6:
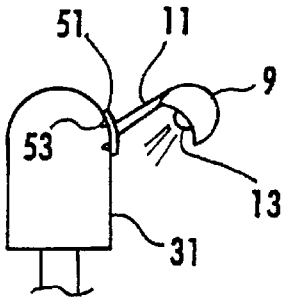
FIG. 6 is a side view of yet another embodiment of the present invention.

FIG. 6 shows the lamp housing 9 and supports 11 fastened by mounting bracket 51 and fasteners 53 to a mail box. With this mounting, the address numbers 31 are directly illuminated by the lamp 13.

With reference back to FIG. 1A, the lamp 13 may be hard wired to the power source of the structure to which the address illumination system is attached for electric power supply. Operation of the lamp 13 may be controlled by a simple on-off switch (not shown).

Alternatively, a control circuit 40 may be provided with the base, lamp and lamp housing arrangement for automatic and/or remote control of the system. First, the lamp 13 can receive power from a household or a building power supply 42 as is conventionally available. Alternatively, the power source 42 may comprise solar cells or rechargeable batteries which are removable for recharging by a remote recharger or rechargeable in place by conventional or solar means.

The lamps 13 may be controlled by a control means 41 which can operate one or more electrical components for different types of control. First, a conventional flasher may be provided to cause the lamps 13 to flash for signaling emergency vehicles, deliveries, or nighttime visitors. The flasher 43 may be operated directly through the control means 41 or via a remote control system 46 comprising a transmitter 45 located remotely from the control means and a receiver 47 connected thereto. Remote operation of the transmitter 45 can then signal the control means and flasher to flash the lamps 13 when desired.

The control circuit can also include control using a photocell 49 such that the lamps 13 operate automatically during nighttime hours. Alternatively, a timer 51 can be provided to turn the lamps 13 on and off at predetermined intervals.

Since each of the above-described electrical components are well known in the art, a detailed electrical circuitry diagram is not required for understanding of the invention.

With reference now to FIGS. 7–11, another embodiment of the address illuminating device is generally designated by the reference numeral 50 and seen to include a base 51 having a front face 53 and a rear face 55. The front face 53 includes an exemplary display indicia 56 represented by numbers 57 and letter 58.

Directly mounted to the base 51 at an upper portion thereof is an enclosure 59. The enclosure comprises side walls 61, front plate 63 and top plate 65. The enclosure houses circuitry for the control aspect of the illuminating device such as the flashing or photocell features, including the necessary wiring, etc.

In this embodiment, a photocell 67 is shown mounted on the front plate 63. However, the photocell could be mounted in another location, if desired.

A tubular lamp housing 69 is also provided as part of the enclosure 59. In this embodiment, the tubular housing 69 is retained between the side walls 61 of the enclosure 59 by screws 71.

The tubular housing 69 is hollow to receive the lamp 73, see FIG. 10. The housing includes an elongated opening or aperture 75 which allows access to the lamp 73 for installation or removal from the lamp socket 77. The opening 75 also allows insects or the like to escape from within the tubular housing 69.

The housing 69 also encloses the wires 79 leading to and from the lamp sockets 77 for its operation. Although the lamp housing 69 is shown in a tubular configuration, it can take other shapes such as a square cross section or the like. Moreover, the enclosure 59 can double as a housing for the lamp 73 such that a separate tubular housing is not needed.

The opening 75 is directed in a manner to flood the indicia 56 on the base front face 53. Preferably, the aperture is oriented about 90° with respect to the front face 53 of the base 51. However, the aperture can vary from this orientation, e.g., be more acutely angled with respect to the base depending on variables such as lamp wattage, size of the indicia 56 or the like.

The enclosure 59 should be weathertight with respect to the control circuitries to avoid premature failure of the device.

With reference to FIG. 11, a lead to an external power source is identified by the reference numeral 81.

The rear face 55 includes key hole slots 83 which may be utilized to mount the rear face 55 flush to a surface of a structure. Of course, other means for mounting such as adhesives, fasteners, brackets or the like may be utilized for mounting purposes.

It should be understood that the teachings of the embodiments of FIGS. 1–6 also apply to the embodiment shown in FIGS. 7–11.

The lamps 13 may be any known type capable of providing sufficient illumination for the display symbols 3. Preferably, the lamps are a low voltage type which are angled with respect to the display symbols for maximum illumination. The base 1 can be formed as a solid plate such that any electrical control components would be located remote from the base attachment. For example, and with reference to FIG. 4, the lamp housings 39 would be connected to the appropriate switch and/or control circuitry via underground wiring. In an alternative embodiment, the base 1*a*, see FIG. 2, can be manufactured with a hollow construction such that electronic components can be located within a chamber formed by the hollow base 1*a*. In this embodiment, and when the power source 42 comprises rechargeable batteries recharged by solar power, the inventive address illumination system is completely independent of an external power source. Further, the remote control feature of the invention permits installation of the address illumination system in locations where an external power source is not readily available. The system can also be designed for low voltage operation to facilitate user installation.

As such, an invention has been disclosed in terms of preferred embodiments thereof which fulfill each and everyone of the objects and advantages of the present invention as set forth hereinabove and provide a new and improved address illumination system.

Of course, various changes, modifications and alterations from the teachings of the present invention may be contemplated by those skilled in the art without departing from the intended spirit and scope thereof. Accordingly, it is intended that the present invention only be limited by the terms of the appended claims.

We claim:

1. An address illumination system for mounting to an exterior surface of one of a residential and a commercial building to provide a beacon to permit a visitor to locate said one of the residential and the commercial building comprising:

a) a base plate having a front face, a rear face, a top edge and a bottom edge, said base plate including openings for flushly mounting said rear face to an exterior surface of one of the residential or the commercial building;

b) at least one address indicia having a front and back side, said back side being mounted to said front face of said base plate;

c) at least one illumination source connectable to a power source, said illumination source further comprising:

i) at least one elongated lamp;

ii) an elongated enclosure mounted directly to said front face of said base plate and along the top edge thereof, the elongated enclosure having opposing side walls, each side wall including a curved portion in abutting relationship with the front face, each curved portion supporting a tubular lamp enclosure with said at least one elongated lamp therein, the tubular lamp enclosure including a rectangularly-shaped opening facing said at least one address indicia to permit access to said at least one elongated lamp, said at least one address indicia mounted below said elongated enclosure so that said at least one elongated lamp directly illuminates said at least one address indicia; and d) means for controlling on/off operation of said at least one lamp comprising a photocell for controlling on/off operation of said at least one elongated lamp during daylight hours, means for flashing said at least one elongated lamp, and means for connecting said at least one elongated lamp to said power source.

2. The address illumination system of claim 1 wherein said power source is selected from the group consisting of a solar power source and a battery powered source.

3. The address illuminator system of claim 1 wherein said at least one address indicia comprises a plurality of numbers or letters to represent a structure location.

4. The address illuminator system of claim 1 further comprising a means for controlling on/off operation of said illumination source using a timer.

5. The address illuminator system of claim 1 wherein said at least one address indicia comprises a plurality of numbers made from a material selected from the group consisting of a brass-containing material, an anodized aluminum-containing material, and a plastic material.

6. The address illuminator system of claim 1 wherein said means for flashing is mounted within said enclosure and said photocell is mounted to said enclosure.

7. An address illumination system for mounting to an exterior surface of one of a residential and a commercial building to provide a beacon to permit a visitor to locate said one of the residential and the commercial building comprising:

a) a base plate having a front face, a rear face, a top edge and a bottom edge, said base plate including openings for flushly mounting said rear face to an exterior surface of one of the residential or commercial buildings;

b) at least one address indicia having a front and back side, said back side being mounted to said front face of said base plate;

c) at least one illumination source connectable to a power source, said illumination source further comprising:

i) at least one elongated lamp;

ii) an elongated enclosure mounted directly to said front face of said base plate and along the top edge thereof, the elongated enclosure having opposing side walls, each side wall including a curved portion in abutting relationship with the front face, each curved portion supporting a tubular lamp enclosure with said at least one elongated lamp therein, the tubular lamp enclosure including a rectangularly-shaped opening facing said at least one address indicia to permit access to said at least one elongated lamp, said at least one address indicia mounted below said elongated enclosure so that said at least one elongated lamp directly illuminates said at least one address indicia; and d) means for controlling on/off operation of said at least one lamp comprising a photocell for controlling on/off operation of said at least one elongated lamp during daylight hours and means for connecting said at least one elongated lamp to said power source.

* * * * *